United States Patent [19]

Culbertson et al.

[11] 4,385,217

[45] May 24, 1983

[54] FLUSHABLE MANIFOLD FOR DIAPHRAGM PROTECTED COMPONENTS

[75] Inventors: Samuel W. Culbertson, Arvada; Keith G. Williams, Boulder, both of Colo.

[73] Assignee: Binks Manufacturing Company, Franklin Park, Ill.

[21] Appl. No.: 254,999

[22] Filed: Apr. 16, 1981

[51] Int. Cl.[3] ..... H01H 35/40

[52] U.S. Cl. ..... 200/81.9 R; 200/83 J; 138/42; 92/101

[58] Field of Search ..... 200/82 R, 81 R, 81.9 R, 200/83 J, 153 T, 83 R; 92/98 R, 99, 101; 340/603, 606, 611, 626; 307/118; 138/42; 239/112, 113

[56] References Cited

U.S. PATENT DOCUMENTS

| | | | |
|---|---|---|---|
| 3,548,133 | 12/1970 | Clauson | 200/81.9 R |
| 3,744,762 | 7/1973 | Schlicht | 138/42 |
| 3,958,092 | 5/1976 | Hoover | 200/81.9 M |
| 3,964,875 | 6/1976 | Chang | 138/42 |

*Primary Examiner*—G. P. Tolin

*Attorney, Agent, or Firm*—Gary, Juettner & Pyle

[57] ABSTRACT

A flushable manifold for diaphragm protected components of a pressure transducer for sensing a flow of fluid comprises a housing having a recess therein and a diaphragm of flexible material over and closing the recess. Inlet and outlet passages communicate with the recess adjacent to and on opposite sides of its periphery, such that fluid introduced at the inlet flows through the manifold to the outlet, with the presence of fluid pressure within the manifold being detected in response to outward deflection of the diaphragm. To facilitate cleaning the manifold of fluid of one type in preparation for receiving fluid of another, one or more channels are formed in the housing within the recess in communication with the inlet and extend toward peripheral side areas of the recess to direct flushing media introduced at the inlet across all of the surfaces of the manifold and to the outlet to thoroughly clean the same. Absent the channels "dead spaces" would exist in the manifold and the flushing media would tend to follow a straight line path of least resistance between the inlet and outlet, thereby failing to satisfactorily clean side areas of the manifold.

6 Claims, 3 Drawing Figures

FLUSHABLE MANIFOLD FOR DIAPHRAGM PROTECTED COMPONENTS

BACKGROUND OF THE INVENTION

The present invention relates to manifolds for diaphragm protected components, through which a fluid flows, and in particular to such a manifold for a pressure transducer for fluids which may readily be flushed of fluid of one type in preparation for a flow therethrough of fluid of another type.

Pressure transducers are often used in connection with spray coating systems, and are placed in line with a paint supply line to a spray paint apparatus to sense the pressure of paint in the line and to generate an indication of system failure in the absence of pressure. Such transducers conventionally comprise a circular recess in a housing and a diaphragm of flexible material sealed with the housing over and around the recess. Inlet and outlet passages communicate with the recess adjacent its circumference at positions approximately 180° apart to form a manifold with the housing and diaphragm and means, such as a microswitch, senses outward deflection of the diaphragm in response to pressure of paint in the manifold.

When articles are required to be coated a wide variety of colors, it is generally not practical to establish separate spray stations or production lines for each color, or even spray a long sequence of articles one color, then another long sequence of articles a second color, etc. Instead, it is desirable to be able to make color changes rapidly and simply at a single spray station, and for the purpose color change systems are useful. With such systems a plurality of supply containers of paint, each of a different color, are connected with a manifold through valve controlled ports. An outlet from the manifold is connected, for example through a metering pump, with the paint supply line, and to spray paint of a particular color the port valve associated therewith is opened to provide the paint through the manifold to the supply line. After completion of spraying articles one color the manifold, metering pump, supply line, pressure transducer and spraying apparatus are flushed with solvent and compressed air to clean the system in preparation for spraying articles another color.

For rapid color changes on high volume production lines, it is necessary that system components be capable of being rapidly flushed by flushing media during color change operations. Unfortunately, conventional pressure transducers of the type described are not readily flushable of coating material, since in such transducers "dead end" spaces exist in the manifold to the sides of the inlet and outlet and flushing media tends to follow a straight line path of least resistance between the inlet and outlet. Consequently, unless the flushing intervals are excessively long, which usually cannot be accommodated in high volume production lines, the entirety of the surfaces of the manifold are not cleaned and subsequently supplied paint is contaminated.

OBJECT OF THE INVENTION

The primary object of the present invention is to provide an improved structure for a manifold of a transducer for sensing the pressure of fluid, wherein the manifold may readily be flushed of fluid of one type in preparation of receiving fluid of another.

SUMMARY OF THE INVENTION

In accordance with the present invention, a manifold for accommodating a flow of fluid therethrough and configured for readily being flushed of the fluid by flushing media, comprises a housing having a chamber therein and an inlet to and an outlet from the chamber in proximity to and on opposite sides of the periphery thereof. At least one channel is formed in the housing in the chamber in communication with the inlet and extending toward peripheral side areas of the chamber, whereby flushing media introduced at the inlet flows through the chamber to the outlet, with at least one channel distributing the flushing media to all of the surfaces of the manifold for thoroughly cleaning the same of fluid.

In a preferred embodiment, the manifold forms a portion of a pressure transducer for fluids which comprises a housing having a circular recess therein, an inlet to and an outlet from the recess in proximity with the circumference of the recess and on opposite sides thereof, and a generally crescent shaped channel formed in the housing in the recess in proximity to and generally coaxial with the circumference. The channel has an arcuate extent less than the circumference and extends across the inlet but not the outlet, a diaphragm of flexible material is sealed to the housing around and across the circumference of the recess and means are provided for sensing outward flexure of the diaphragm in response to occurrence of fluid under at least a selected pressure in the recess. In this manner, fluid introduced at the inlet flows through the recess to the outlet and the sensing means senses whether the fluid has at least the selected pressure, and flushing media introduced at the inlet flows through the recess to the outlet, with the channel distributing the flushing media to all of the surfaces of the diaphragm and recess to thoroughly clean the same of fluid.

The foregoing and other objects, advantages and features of the invention will become apparent upon a consideration of the following detailed description, when taken in conjunction with the accompanying drawings.

DETAILED DESCRIPTION

Figure 1:
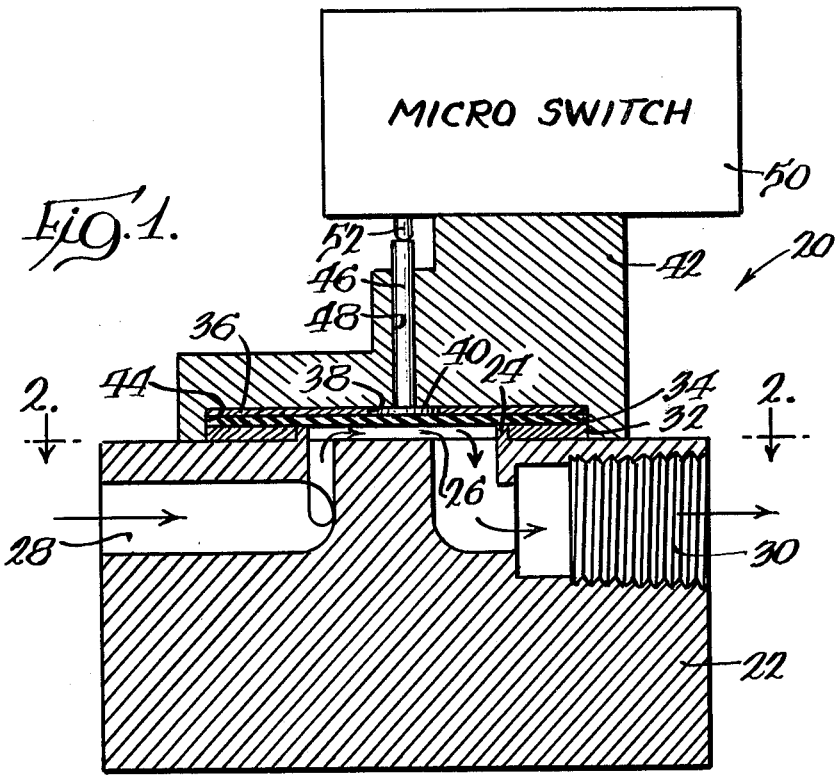
FIG. 1 is a cross sectional side elevation view of a transducer for sensing the pressure of fluids, having a flushable manifold structured in accordance with the teachings of the invention.
Figure 2:
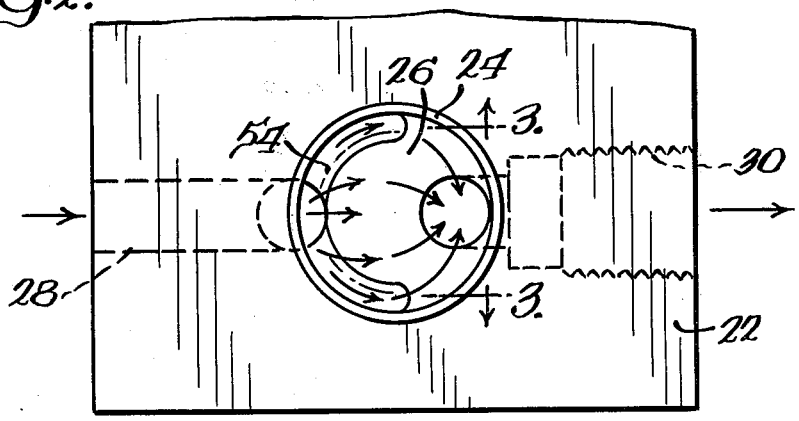
FIG. 2 is a plan view taken substantially along the lines 2—2 of FIG. 1, and illustrates the configuration of the manifold and a crescent shaped channel formed therein for facilitating flushing of the manifold.

FIGS. 1 and 2 illustrate a pressure transducer, indicated generally at 20, having a flushable manifold configured in accordance with the teachings of the present invention. With reference also to FIG. 2, the transducer includes a lower housing 22 having on its upper surface a raised annular wall portion 24 within which is defined a circular opening or recess 26. An inlet 28 to the housing is connectable with a supply of fluid (not shown) such as paint, and communicates with the recess adjacent its circumference. An outlet 30 from the housing is connectable with a point of delivery of the fluid, for example spray coating apparatus (not shown), and communicates with the recess adjacent its circumference and at a point substantially diametrically opposite or about 180° from the inlet.

To enclose the recess 26 for a flow of paint therethrough from the inlet to the outlet, an annular gasket or seal 32 is around the outer circumference of the annular wall 24 and a diaphragm 34 of a flexible material is on the seal and closes the opening. An outer disc or plate 36 of relatively rigid material and having a circular opening 38 formed centrally therethrough is on the upper surface of the diaphragm, and an inner circular disc or plate 40 of relatively rigid material is received within the opening. An upper housing 42 mounted on the upper surface of the lower housing receives the seal 32, diaphragm 34 and plates 36 and 40 within a circular recess 44 in a lower surface thereof. A plunger 46 is slidable within a bore 48 in the upper housing, a microswitch 50 having an actuating lever 52 is mounted on the upper housing and the plunger is of sufficient length to extend between and contact the actuating lever and the disc 40.

With the diaphragm 34 closing the recess 26, a manifold is defined by the recess and diaphragm for a flow of fluid between the inlet 28 and the outlet 30. The microswitch actuating lever 52 is urged downwardly by any suitable means, such as by a spring within the microswitch, so that in the absence of fluid under pressure within the manifold the lever moves to a downward position and forces the plunger 46, the disc 40 and the center portion of the diaphragm 34 downwardly to a point whereat the lower surface of the inner disc 40 extends beneath the lower surface of the outer disc 36, although not to an extent that the upper surface of the inner disc is beneath the lower surface of the outer disc. Under this condition, an output (not shown) from the microswitch indicates a pressure of fluid within the manifold which is less than a selected pressure. However, upon the fluid in the manifold having at least the selected pressure, the center portion of the diaphragm is moved upwardly to move the disc 40, the plunger and the actuating lever upwardly, so that the output from the microswitch then indicates a pressure of fluid within the manifold which is at least equal to the selected pressure.

When connected in line with a coating material or paint supply conduit for spray coating apparatus, such that the inlet 28 connects with a supply of paint under pressure and the outlet 30 with the spray coating apparatus, the transducer output indicates whether the pressure of paint supplied to the apparatus is greater or less than the selected pressure. Such information is particularly useful and necessary, particularly with automatic and often unsupervised spray paint systems which require that paint be supplied at at least the selected pressure for proper coating of articles. Should the pressure fall below the selected value, perhaps as a result of failure of the material supply pump or rupture of the supply line, the output from the microswitch may be used to terminate system operation and warn an operator of system failure.

In spray coating operations it is often necessary to paint articles a wide variety of colors, and it is often not practical to establish separate spray coating stations or production lines for the purpose, or for that matter to spray a long sequence of articles one color, and then another long sequence of articles a second color, etc. Instead, color change systems are often used, and enable a plurality of supply containers of paint of different colors to be selectively connected with the supply line to provide to the spray coating apparatus paint of a selected color. Upon changing from paint of one color to paint of another, to prevent contamination of the subsequently sprayed paint it is necessary that the entirety of the spray paint system, including the pressure transducer, first be cleansed of the previously supplied paint. For the purpose, the inlet to the system, whereat it otherwise connects with containers of paint, is connected with a supply of flushing media which usually comprises alternate applications of solvent for the paint and compressed air, whereby flushing media flows through the entirety of the system to cleanse the same.

To the extent described, the pressure transducer 20 is of generally conventional structure and it is relatively difficult to thoroughly and quickly clean the manifold of one color of paint in preparation for spraying another color. That is, flushing media introduced at the inlet 28 tends to follow a path of least resistance through the manifold and generally flows in a straight line between the inlet and outlet. This leaves areas in the manifold to opposite sides of a line between the inlet and outlet which are not cleaned. Consequently, absent an unreasonably long duration flow of flushing media, which is usually not feasible with high volume production line requirements, portions of the diaphragm 34 and of the wall areas of the recess 26 remain contaminated with paint of one color at the time of supply of paint of another color, which can impair the quality of the color of the subsequently sprayed paint.

Figure 3:
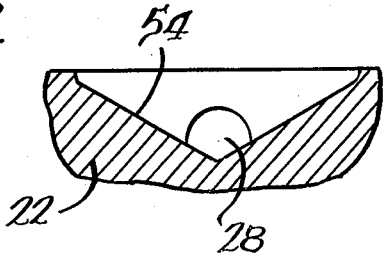
FIG. 3 is taken substantially along the lines 3—3 of FIG. 2, and shows the cross sectional configuration of the crescent shaped channel.

In overcoming the disadvantages of conventional pressure transducers, and as is best shown in FIGS. 2 and 3, in accordance with the present invention at least one channel is formed in the housing 22 within the recess 26, and extends between the inlet 28 and side areas of the recess. For the particular embodiment of invention shown, the at least one channel comprises a crescent shaped channel, cavity or recess 54 formed in the surface of the housing within the recess adjacent to and along the circumference thereof, and the channel has an arcuate extent of about 180° and intersects the inlet at about its midpoint. The walls of the channel may have any suitable configuration, for example the V-shaped cross section shown, and the geometry of the channel causes flushing media introduced at the inlet to readily flow to the side areas of the manifold and across the entirety of the face of the diaphragm and the wall areas of the recess as it flows from the inlet to the outlet. Consequently, during color change operations flushing media introduced at the inlet readily, rapidly and uniformly flows across and contacts all of the manifold surfaces to thoroughly and quickly clean the same of coating material, whereby the time required to clean the transducer is considerably shortened and no contamination of subsequently supplied coating material occurs.

While embodiments of the invention have been described in detail, various modifications and other embodiments thereof may be devised by one skilled in the art without departing from the spirit and scope of the invention, as defined in the appended claims.

What is claimed is:

1. A pressure transducer for liquids, comprising a housing having a cylindrical recess therein, said recess having a circular side wall, a generally planar lower surface and an open upper end, an inlet to and an outlet from said recess formed through said lower surface adjacent to and on opposite sides of the circumference of said side wall approximately 180° apart, a crescent shaped recessed groove formed in said lower surface adjacent to and along the circumference of said side wall, said groove having an arcuate extent less than the circumference of said side wall and intersecting said inlet, but not said outlet, at about the midpoint of said arcuate extent thereof so that said groove extends to areas of said recess to the sides of said inlet and outlet; a generally planar diaphragm of flexible material on said housing over and closing said upper end of said recess, the spacing between said recess lower surface and said diaphragm being small compared to the diameter of said side wall; and means for sensing outward flexure of said diaphragm in response to occurrence of liquids under at least a selected pressure in said recess, whereby liquid introduced at said inlet flows through said recess to said outlet and said sensing means senses whether the liquid has at least said selected pressure, and whereby liquid flushing media introduced at said inlet flows within said groove and through said recess to said outlet, said groove distributing the flushing media to all of the surfaces of said diaphragm and recess to thoroughly clean the same of liquid.

2. A pressure transducer as in claim 1, wherein said groove extends approximately 180° around the arcuate extent of said recess side wall.

3. A manifold for accommodating a flow of liquid therethrough and configured for readily being flushed by liquid flushing media, comprising a housing having a cylindrical chamber therein, said chamber having substantially planar and parallel top and bottom walls, a circular side wall and a spacing between said top and bottom walls which is small relative to the diameter of said side wall, an inlet to and an outlet from said chamber formed through at least one of said top and bottom walls adjacent to said side wall substantially 180° apart, and at least one crescent shaped recessed groove formed in at least one of said top and bottom walls adjacent to and along the circumference of said side wall, said groove having an arcuate extent less than the circumference of said side wall and intersecting said inlet, but not said outlet, at about the midpoint of said arcuate extent thereof, so that said groove extends to areas of said chamber to the sides of said inlet and outlet, whereby flushing media introduced at said inlet flows within said at least one groove to areas of said chamber to the sides of said inlet and outlet and through said chamber to said outlet, said at least one groove distributing the flushing media to all of the surfaces of said manifold for thoroughly cleaning the same of liquid.

4. A manifold as in claim 3, wherein said groove extends along a portion but less than the entirety of the circumference of said side wall of said chamber.

5. A manifold as in claim 3, wherein said groove extends approximately 180° around the arcuate extent of said chamber side wall.

6. A manifold as in claim 3, wherein said groove has a generally V-shaped cross section along a radius of said chamber.

* * * * *